US008919382B2

(12) United States Patent
Johannessen

(10) Patent No.: US 8,919,382 B2
(45) Date of Patent: Dec. 30, 2014

(54) DRAINAGE SYSTEM AND A VORTEX BRAKE

(75) Inventor: Jørgen Mosbæk Johannessen, Køge (DK)

(73) Assignee: Mosbaek A/S, Koge (DK)

( * ) Notice: Subject to any disclaimer, the term of this patent is extended or adjusted under 35 U.S.C. 154(b) by 581 days.

(21) Appl. No.: 13/378,860

(22) PCT Filed: Jun. 15, 2010

(86) PCT No.: PCT/DK2010/050139

§ 371 (c)(1),
(2), (4) Date: Jan. 10, 2012

(87) PCT Pub. No.: WO2010/145662

PCT Pub. Date: Dec. 23, 2010

(65) Prior Publication Data

US 2012/0097281 A1 Apr. 26, 2012

(30) Foreign Application Priority Data

Jun. 17, 2009 (DK) ..... 2009 70032

(51) Int. Cl.
*E03F 5/10* (2006.01)

(52) U.S. Cl.
CPC ..... *E03F 5/106* (2013.01)
USPC ..... 137/810; 137/811; 137/238; 405/41

(58) Field of Classification Search
CPC ..... E03F 5/106; F15C 1/16; F15D 1/0015; F16L 45/00
USPC ..... 137/808–811, 237, 238; 405/39–41
See application file for complete search history.

(56) References Cited

U.S. PATENT DOCUMENTS

| | | | | | |
|---|---|---|---|---|---|
| 4,206,783 | A | * | 6/1980 | Brombach | 137/810 |
| 4,679,595 | A | * | 7/1987 | Johannessen | 137/813 |
| 4,889,166 | A | * | 12/1989 | Lakatos | 137/813 |
| 5,052,442 | A | * | 10/1991 | Johannessen | 137/813 |
| 5,080,137 | A | * | 1/1992 | Adams | 137/810 |

(Continued)

FOREIGN PATENT DOCUMENTS

| | | | |
|---|---|---|---|
| GB | 2 254 938 | A | 10/1992 |
| GB | 2 271 438 | A | 4/1994 |

(Continued)

OTHER PUBLICATIONS

International Search Report (PCT/ISA/210) issued on Oct. 1, 2010, by Danish Patent Office as the International Searching Authority for International Application No. PCT/DK2010/050139.

(Continued)

*Primary Examiner* — Craig Schneider
(74) *Attorney, Agent, or Firm* — Buchanan Ingersoll & Rooney P.C.

(57) ABSTRACT

A drainage system is provided that comprises a gully having a circumferential side wall, an outlet and a vortex brake with a vortex chamber having a chamber wall with a peripheral inlet opening and a central outlet opening, the vortex brake being arranged in the gully so that a flow path from the inside of the gully to the outlet leads through the vortex brake, and a drainpipe is connected to the outlet. The vortex brake is arranged in the gully so as to be non-demountable, and the vortex brake is provided with a flushing access having a hose connection.

20 Claims, 2 Drawing Sheets

(56) References Cited

U.S. PATENT DOCUMENTS

Figure 1:
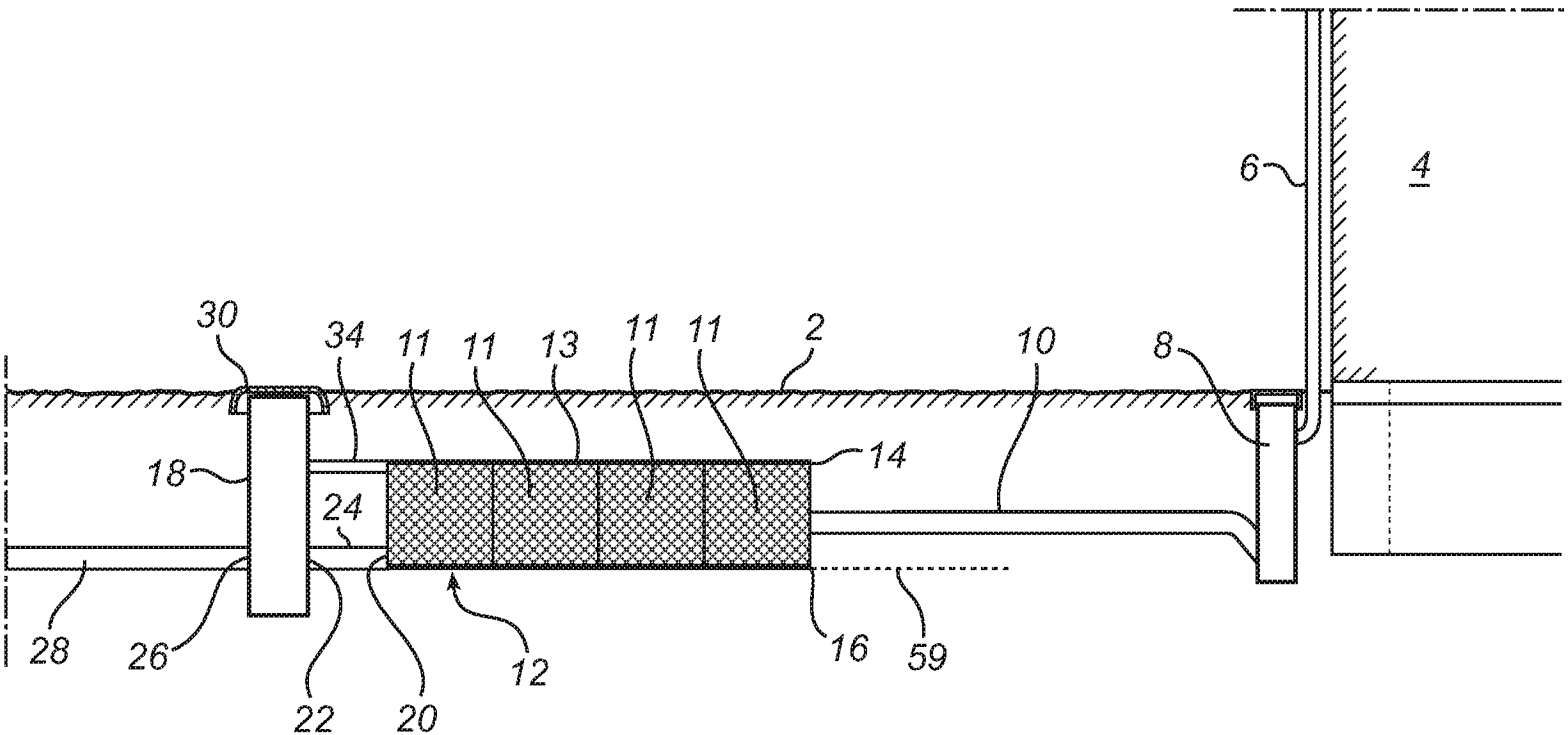

| | | | | |
|---|---|---|---|---|
| 5,303,782 | A | 4/1994 | Johannessen | |
| 5,543,038 | A | 8/1996 | Johannessen | |
| 5,640,988 | A * | 6/1997 | Brereton | 137/14 |
| 6,053,206 | A * | 4/2000 | Johannesen | 137/810 |
| 6,082,925 | A * | 7/2000 | Raasch | 404/2 |
| 8,397,761 | B2 * | 3/2013 | Johannessen | 137/810 |

FOREIGN PATENT DOCUMENTS

| | | | |
|---|---|---|---|
| GB | 2 424 718 | A | 10/2006 |
| WO | WO 87/07048 | A1 | 11/1987 |
| WO | WO 2005/017270 | A1 | 2/2005 |
| WO | WO 2007/052243 | A1 | 5/2007 |
| WO | WO 2008/064683 | A1 | 6/2008 |
| WO | WO 2008/138347 | A1 | 11/2008 |

OTHER PUBLICATIONS

Udstillingskatalog (Exhibition Catalog) of Rorcemterdagene 2009, 17. og 18. juni (Pipe centre days Jun. 17 and 18, 2009) pp. front, rear and p. 45, with a publication date believed to be during the period of May 25 to Jun. 5, 2009 (and English-langauge translation thereof).

* cited by examiner

DRAINAGE SYSTEM AND A VORTEX BRAKE

The present invention relates to a drainage system comprising a gully having a circumferential side wall, an outlet and a vortex brake with a vortex chamber having a chamber wall with a peripheral inlet opening and a central outlet opening, the vortex brake being arranged in the gully so that a flow path from the inside of the gully to the outlet leads through the vortex brake, a drainpipe being connected to the outlet. The present invention further relates to a vortex brake with a vortex chamber having a chamber wall with a peripheral inlet and a central outlet opening.

Such drainage system is known from WO-A-87/07048, in which one embodiment is described as a gutter gully provided at the outlet with a disc-shaped vortex brake having a horizontal axis. The vortex brake has an inlet at the bottom and a central outlet, whereby the vortex brake provides a water seal. The vortex brake is provided with an upwardly projecting rod provided with a handle for mounting and demounting the vortex brake. In the embodiment shown, the vortex brake has been mounted subsequently in the gully, which in itself provides a water seal at its outlet. It should be noted that it is inexpedient and normally not lawful to provide two serial water seals without any intermediate venting.

WO-A-2005/017270 describes a gully having an outlet at which a vortex brake is mounted, and a screen or grid is mounted in front of the vortex brake to prevent large impurities from entering the vortex brake.

WO-A-2008/064683 describes a disc-shaped vortex brake mounted on an outlet by means of an inclined claw clutch, whereby the vortex brake can be lifted off and on by means of a handle, not shown, at the end of an upwardly projecting vent pipe.

U.S. Pat. No. 5,543,038 shows a drainage system having a gully with a vortex brake at a bottom outlet. The gully is connected to a receiver in the form of a reservoir for storing water when the inlet flow to the gully is bigger than the outlet flow permitted by the vortex brake, and from which the water returns to the gully when the inlet flow to the gully again becomes smaller than the outlet flow through the vortex brake.

GB-A-2 271 438 describes a gully having a vortex brake mounted at an outlet so as to be non-demountable. The vortex brake has a conical side wall section and a plane end wall section provided with an opening with a displaceable cover to enable the brake inlet to be bypassed if it is blocked.

GB-A-2 424 718 describes a flash flood control chamber divided into an inlet chamber and an outlet chamber communicating through a restrictor orifice. The inlet chamber has an inlet, and the outlet chamber has an outlet at a lower level. The restrictor orifice is arranged on a level with the outlet. In addition, there is an overflow from the inlet chamber.

Due to the increasing $CO_2$ content in the atmosphere and the resulting greenhouse effect and global warming, climatic changes are expected to result in increasing quantities of precipitation, particularly per rain event. This will imply a heavier load on water drainage systems.

In a water drainage system it is known to insert hydraulic brakes, such as vortex brakes, at various places to avoid hydraulic overload of system components downstream of the brakes. In case of a heavy rain event where the brake becomes active, a system component upstream of a brake or an area at such a system component will act as a reservoir for stored water which will later run through the brake when the inflow decreases again. An area such as the one mentioned may be a parking lot or a similar area with a rainwater gully in which the brake is mounted. Thus, the areas in question are often public areas maintained by public employees who clean the brakes and ensure their correct functioning in case of blocking.

In future, it may become necessary to mount brakes in gullies, such as rainwater gullies, on private land. In that case it will cause a problem if the landowner removes the brake, for example, to avoid flooding.

The object of the present invention is to provide a drainage system and a vortex brake that eliminate this problem.

According to the invention, the object is obtained in that the vortex brake is arranged in the gully so as to be non-demountable and in that the vortex brake is provided with a flushing access with a hose connection. By arranging the vortex brake so as to be non-demountable in the gully, the problem of the landowner removing the brake is eliminated. However, it causes the problem that the brake cannot be demounted for cleaning in case of blocking. To solve this introduced problem, a flushing access with a hose connection is provided. This allows a water supply hose to be connected with the brake, and in case of blocking water is passed through the water supply hose to flush the vortex brake from the inside so that impurities, which will particularly tend to block the inlet to the brake, are flushed away.

The flushing access is preferably arranged outside an area defined by an angle of 45°, preferably 60°, from the vertical and with its apex at a central position in the outlet opening. This prevents the flushing access from acting as a vent of the brake, whereby an air pocket caught in the vortex chamber when the vortex brake becomes active would be driven out to the detriment of a desired characteristic of the vortex brake.

In a preferred, practical embodiment, the chamber wall comprises a curved side wall section extending about a vortex axis of the vortex brake, and the flushing access comprises a flushing opening in the curved side wall section.

The flushing access with the hose connection is preferably adapted for directing a jet of liquid at the peripheral inlet opening. This provides an efficient possibility of cleaning the inlet of blocking impurities.

In a practical embodiment, the vortex brake is provided with a connecting piece integral with the chamber wall and preferably extending through the side wall of the gully and being connected with the drainpipe so as to be non-demountable. The connecting piece may be inserted in a usual socket in a drainpipe. Such sockets are provided with lip seals which permit the joining of components, that is, the insertion of a connecting piece, but offer large resistance to extraction of the connecting piece, particularly when the components have been joined for some time. It should be mentioned in this connection that 'non-demountable' is to be understood as 'in practice' and particularly as opposed to embodiments in which a vortex brake is arranged so that it can directly be lifted for release from a coupling, see, for example, WO-A-2008/064683 mentioned above.

Preferably the connecting piece and the outlet opening are arranged mutually eccentrically so that the centre of the outlet opening is placed below the centre of the aperture of the connecting piece. In this way, the connecting piece may be arranged so that the lower rim of the outlet opening is placed at the inside wall of the connecting piece so that there is no noticeable loss of height for liquid when flowing through the vortex brake.

In one embodiment of the system according to the invention, the gully has an inlet connected to a fascine with a vertical extent between an upper level and a lower level and an outlet connected to the inlet of the gully.

The object of the invention is further obtained by means of a vortex brake with a vortex chamber having a chamber wall with a peripheral inlet and a central outlet opening, which is characterized in that the vortex brake is adapted for non-demountable mounting, and that the vortex brake is provided with a flushing access with a hose connection. This provides the advantages mentioned in relation to the drainage system according to the invention.

To prevent the flushing access from acting as a vent, the vortex brake preferably has a position of use so that the flushing access in the position of use is arranged outside an area defined by an angle of 45°, preferably 60°, from the vertical and with its apex in a central position in the outlet opening. In one embodiment, this corresponds to an angular displacement of the flushing access of a maximum of 135°, preferably a maximum of 120°, about the centre of the central outlet opening from the peripheral inlet opening in the flow direction.

In relation to embodiments in which the inlet of the gully is connected to a fascine, it may be mentioned that it is known in connection with draining of rainwater from, for example, roofs, balconies and consolidated areas such as terraces and yards either to guide the water to the sewer or to a fascine, usually through a gully with a catchpit and a gully trap which retains floating matter. In principle, a fascine is a hole in the ground filled with one or more solid bodies with cavities and/or mutual spaces. As an example, stones may be used, but usually plastic bodies made for the purpose are used, such as those which are marketed under the designation of 'regnvandskassetter', which are box-shaped plastic lattice structures with a cavity percentage exceeding 90 percent and with through-going tubular openings providing access for flushing. The solid body(ies) is/are usually enveloped in a water-permeable membrane or filter cloth to permit water to enter from the fascine out into the soil or vice versa, but to prevent soil from entering the fascine and filling out the cavities in and between the bodies, which would ruin the function of the fascine. The body(ies) in the fascine prevent(s) the soil above the fascine from caving in.

As the gully has an inlet connected to a fascine, rainwater can be guided to the fascine, from where it may seep out into the soil to the extent that the soil can absorb the water, and from where the rainwater may run on to the gully and through the vortex brake in a controlled manner on to, for example, the sewer. In this way, the sewer will not be subject to any load as long as the soil can absorb the water, while drainage from the fascine is possible when the soil is unable to absorb the water, without the drainage from the fascine overloading a receiving network, such as the sewer, thanks to the liquid brake.

In a preferred, practical embodiment, the fascine is connected to a rainwater gully.

The fascine preferably comprises a cavity below the soil surface, the cavity being filled with one or more solid bodies with holes and/or intermediate spaces, and the solid body(ies) is/are preferably at least partly enveloped by a water-permeable membrane, such as a filter cloth.

In a preferred, practical embodiment, the inlet of the gully provides a cleaning access for the fascine. It is thus rendered possible, for example, to insert a water hose with a flushing head from the gully, back through the inlet and into the fascine to flush and clean the filling body of the fascine.

In an advantageous embodiment, the gully has several inlets connected to respective fascines. This makes it possible to obviate some gullies with liquid brakes in a large system or in case of several, mutually proximate systems.

By placing the outlet of the gully or the fascine higher or lower relative to the lower level of the fascine, it is possible to adjust the function of the system.

Accordingly, in one embodiment, the outlet of the fascine and the outlet of the gully are located at the lower level. This makes it possible to empty the fascine through the gully and the liquid brake. At non-heavy rain events, most of the rainwater will therefore run through the fascine to the gully, and in periods without rain, any high-level groundwater will penetrate into the fascine from the surrounding soil and be drained off through the gully. Such drainage of the soil will improve its ability to absorb water at heavy rain events.

In another embodiment, the outlet of the fascine and/or the inlet and/or the outlet of the gully are located above the lower level, preferably at least 25 percent of the vertical extent of the fascine above the lower level. Thereby, water in the fascine will only be drained away to the gully when the fascine is filled up to the level of the higher one of the two said outlets and the inlet. Accordingly, for example the sewer with which the gully may be connected will only be subject to a load in extreme cases.

In cases where it is no problem that the vortex brake can be demounted, a demountable liquid or vortex brake may be used. Accordingly, in another aspect, the invention relates to a drainage system comprising a gully with an upper opening, an outlet, a liquid brake arranged in the gully, and an inlet in the gully, whereby a flow path leads from the inlet to the outlet, the liquid brake being adapted so that the flow path leads through the liquid brake, and the inlet being connected with a fascine with a vertical extent between an upper level and a lower level and an outlet connected to the inlet of the gully. Thereby, the liquid brake is preferably mounted at the outlet of the gully, and the liquid brake is preferably a vortex brake, particularly a disc-shaped vortex brake with a horizontal vortex axis.

A screen with through-flow openings is preferably arranged between the liquid brake and the inlet of the gully to bar the way to rats so that rats cannot enter from a sewer with which the gully may be connected and into the fascine.

Figure 3:
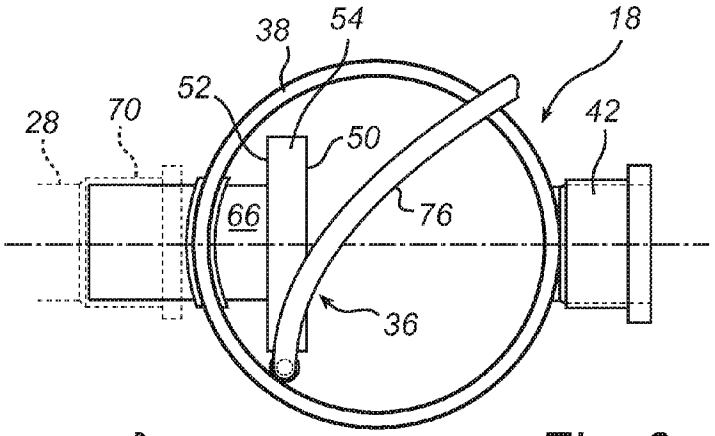
Figure 4:
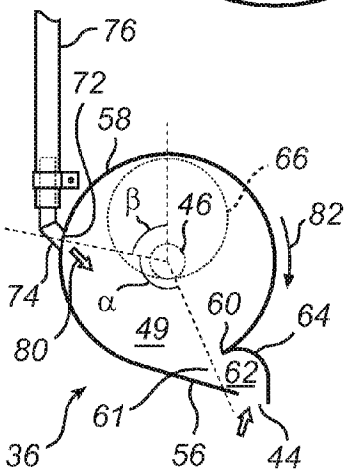
Figure 2:
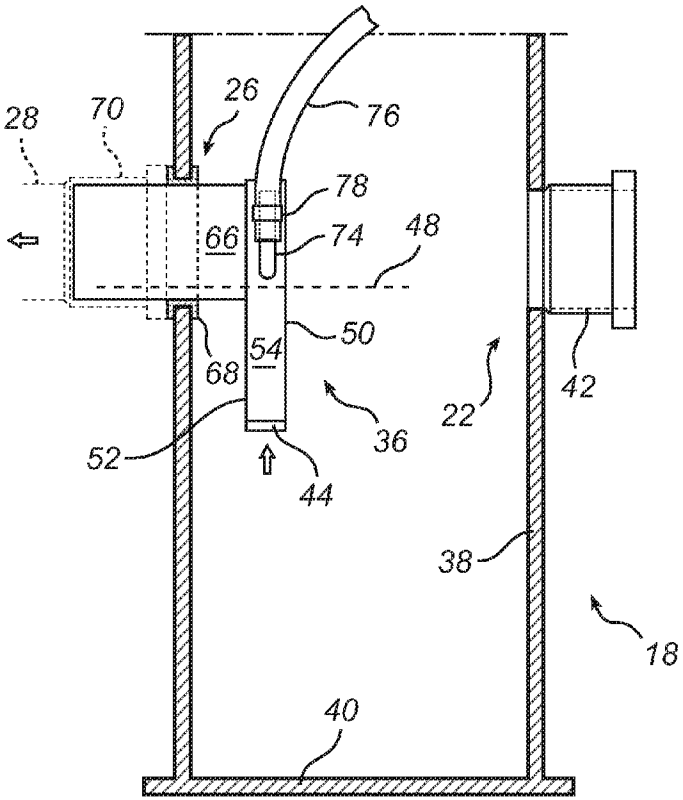

The invention will now be described in more detail below by means of examples of embodiments and with reference to the schematic drawing, in which FIG. 1 shows a vertical section through a drainage system according to the invention, FIG. 2 shows a vertical section through the lower part of a gully according to the invention, FIG. 3 shows a top view of the gully, and FIG. 4 is a front view of a vortex brake in the gully.

FIG. 1 provides a vertical section showing the soil surface 2, a house 4 with a downpipe 6 from a roof gutter, not shown, a downpipe gully 8 to which the downpipe 6 is connected, a drainpipe 10 for draining the downpipe gully 8 and a fascine 12 constructed in a manner known per se from solid bodies or filter blocks 11 enveloped in a water-permeable membrane or filter cloth 13. The fascine 12 extends vertically between an upper level 14 and a lower level 16. A gully or regulating gully 18 is shown without any details. An outlet 20 from the fascine 12 is connected to an inlet 22 in the regulating gully 18 through a connecting pipe 24. An outlet 26 from the regulating gully 18 is connected to the sewer (not shown) through a drain conduit or a drainpipe 28. A gully curb 30 with a cover is arranged above the upper opening of the regulating gully 18. A venting pipe 34 connects the upper part of the fascine 12 with the surroundings in the upper part of the regulating gully 18 to avoid over- or under-pressure in the fascine 12.

FIG. 2 shows the lower part of the regulating gully 18, which is called a regulating gully because it contains a vortex brake 36 or a vortex regulator. The regulating gully 18 comprises a circumferential side wall formed by a gully pipe 38 with a base 40, the inlet 22, which is provided with an inlet socket 42 for connection with the connecting pipe 24, and the outlet 26 at which a vortex brake 36 is mounted. The vortex brake may have a construction known per se, for example as substantially described in the above publication WO-A-2008/064683, and has an inlet opening 44 and a central outlet opening 46 through which a horizontal vortex axis 48 extends. The vortex brake 36 has a vortex chamber 49 defined by a plane front wall 50 and a back wall 52 interconnected by a cylindrical side wall 54, which has a rectilinear section 56 which is integral with a curved section 58 extending to an inside edge 60. A peripheral inlet opening 61 to the vortex chamber 49 is defined between the inside edge 60 and the rectilinear section 56. An inlet chamber 62 with a curved wall 64 extending from the inlet opening 44 to the inside edge 60 is provided between the inlet opening 44 of the vortex brake 36 and the inlet opening 61 of the vortex chamber 49. Like the vortex chamber 49, the inlet chamber 62 is defined between the plane front wall 50 and the plane back wall 52.

For mounting purposes, the vortex brake 36 is provided with a connecting piece 66 extending at right angles to the plane back wall 52 and sealingly connected therewith, whereby the connecting piece 66 is integral with the back wall 52. The connecting piece may, for example, be welded onto the back wall.

As appears from FIG. 4, the connecting piece 66 has a larger aperture than the outlet opening 46, and the connecting piece is arranged so that the centre of its aperture is vertically above the centre of the outlet opening 46 and so that the lowest point of the rim of the outlet opening 46 is aligned with the lowest point of the aperture of the connecting piece 66.

At the outlet 26, the connecting piece 66 is passed through a rubber collar 68 in the wall of the gully pipe 38. The rubber collar 68 seals between the connecting piece and the wall of the gully pipe 38 and also retains the connecting piece 66 by friction and/or adhesion. Outside the gully 18, the connecting piece 66 is inserted into a socket 70 of the drainpipe 28 to connect the outlet 26 with the drainpipe 28. The socket 70 may be of a type known per se with lip seals of rubber or a similar material, which lip seals, due to friction, act as barbs permitting insertion of the connecting piece 66 in the socket 70, but offering strong resistance against subsequent removal of the connecting piece 66. In practice, the vortex brake 36 is thus mounted in a non-demountable manner.

The vortex brake 36 is moreover provided with a flushing access with a hose connection in the form of a flushing opening or a hole 72 in the curved section 58 of the cylindrical side wall 54 and a hose connection 74 fastened on the outside of the cylindrical side wall 54 over the hole 72. FIGS. 2-4 show a water hose 76 mounted on the hose connection 74 by means of a clamp 78. The flushing opening 72 and the hose connection 74 are adapted to direct a water jet in a direction 80 towards the peripheral inlet opening 61 of the vortex chamber 49. The flushing opening 72 is arranged at an angular distance a from the peripheral inlet opening 61 and at an angular distance β from the vertical so that the flushing opening 72 does not act as a vent for an air pocket caught in the vortex chamber 49 when the outlet opening 46 is closed by liquid in the vortex chamber 49.

The gully may have a moderate internal diameter of, for example, 30-65 cm so that it is not possible for an operator to descend into the gully to service the vortex brake. For the illustrated use in connection with a roof drain from a detached family house, the flow through the brake must be in the order of 0.2-1 l/s, for example approx. 0.5 l/s.

To prevent rats from entering into the fascine 12 from the sewer, the vortex brake 36 may be enclosed by a screen grid (not shown) with holes of a size that does not permit a rat to pass.

It is possible to flush the fascine by passing a water hose with a flushing head from the regulating gully 18 through the inlet 22 and the connecting pipe 24 into the fascine 12.

In the configuration shown, the drainage system will work as follows:

At a rain event, rainwater will run from the downpipe gully 8, through the fascine 12 into the regulating gully 18 and through the vortex brake 36 until the flow is so strong that the vortex brake 36 becomes active and limits the flow, a liquid vortex forming about the vortex axis 48 in the direction shown by an arrow 82. The water will then be stored in the fascine and the regulating gully until the rain abates, and the flow to the fascine 12 becomes smaller than the flow allowed by the vortex brake. The fascine will subsequently empty through the regulating gully and the vortex brake. When the fascine is filled, some of the water will penetrate to the surrounding soil. When the fascine again empties, at least part of this water will re-enter the fascine and run out through the regulating gully 18. In the same way, any high-level groundwater 59 will be drained away through the fascine to the sewer.

If it is not desired that rainwater is drained to the sewer to the full extent, it is possible to arrange the outlet 20 from the fascine 12, the inlet 22 of the regulating gully 18 or the outlet 26 from the regulating gully at a higher level. In that case, water will be stored in the fascine up to that level before water is led to the sewer as overflow. It should be noted that if the outlet 26 from the regulating gully 18 and thus the vortex brake 36 is arranged at a higher level, the water will consequently have to be stored up to a correspondingly higher level in the regulating gully to obtain a particular flow through the vortex brake 36. If the outlet from the fascine is arranged at a higher level in this way, the fascine will not empty to the sewer, but water in the fascine will instead penetrate to the surrounding soil at the rate at which the soil can absorb the water.

Due to its non-demountable mounting, the vortex brake cannot be removed from the gully for service in case of blocking. Instead, it is possible in the circumstances to connect the water hose 76 to a tap (drinking water system) and thereby flush the vortex chamber 49 and flush through the inlet, that is, through the inlet opening 61, the inlet chamber 62 and the inlet opening 44.

The invention claimed is:

1. A drainage system comprising a gully having a circumferential side wall, an outlet and a vortex brake with a vortex chamber having a chamber wall with a peripheral inlet opening and a central outlet opening, the vortex brake being arranged in the gully so that a flow path from the inside of the gully to the outlet leads through the vortex brake, a drainpipe being connected to the outlet, wherein the vortex brake is provided with a flushing access with a hose connection and the flushing access is arranged outside an area defined by an angle of 45° or more about a vortex axis of the vortex brake from the vertical and with its apex at a central position in the outlet opening.

2. The drainage system according to claim 1, wherein the chamber wall comprises a curved side wall section extending about a vortex axis of the vortex brake, and the flushing access comprises a flushing opening in the curved side wall section.

3. The drainage system according to claim 1, wherein the flushing access with the hose connection is adapted for directing a jet of liquid at the peripheral inlet opening.

4. The drainage system according to claim 1, wherein the vortex brake comprises a connecting piece integral with the chamber wall and extending through the side wall of the gully and being connected with the drainpipe so as to be non-demountable.

5. The drainage system according to claim 1, wherein the vortex brake comprises a connecting piece integral with the chamber wall, said the connecting piece and the outlet opening being arranged mutually eccentrically so that the centre of the outlet opening is placed below the centre of the aperture of the connecting piece.

6. The drainage system according to claim 1, wherein the gully has an inlet connected to a fascine.

7. The drainage system according to claim 1, wherein said angle is 45°.

8. The drainage system according to claim 1, wherein the vortex brake is arranged in the gully so as to be non-demountable.

9. The drainage system according to claim 1, wherein said angle is 60°.

10. The drainage system according to claim 9, wherein the chamber wall comprises a curved side wall section extending about the vortex axis of the vortex brake, and the flushing access comprises a flushing opening in the curved side wall section.

11. The drainage system according to claim 9, wherein the flushing access with the hose connection is adapted for directing a jet of liquid at the peripheral inlet opening.

12. A vortex brake with a vortex chamber (49) having a chamber wall with a peripheral inlet and a central outlet opening, wherein, the vortex brake is provided with a flushing access with a hose connection, the vortex brake is having a position of use, and the flushing access in the position of use is arranged outside an area defined by an angle of 45° or more about a vortex axis of the vortex brake from the vertical and with its apex at a central position in the outlet opening.

13. The vortex brake according to claim 12, wherein said angle is 60°.

14. The vortex brake according to claim 12, wherein the chamber wall comprises a curved side wall section extending about the vortex axis of the vortex brake, and the flushing access comprises a flushing opening in the curved side wall section.

15. A vortex brake according to claim 12, wherein the vortex brake comprises a connecting piece integral with the chamber wall, and the connecting piece and the outlet opening are arranged mutually eccentrically so that the centre of the outlet opening is placed below the centre of the aperture of the connecting piece when the vortex brake is in its position of use.

16. The vortex brake according to claim 12, wherein the flushing access with the hose connection is adapted for directing a jet of liquid at the peripheral inlet opening.

17. The vortex brake according to claim 12, wherein the flushing access is angularly displaced by a maximum of 135° about the centre of the central outlet opening from the peripheral inlet opening in the flow direction.

18. The vortex brake according to claim 12, wherein said angle is 45°.

19. The vortex brake according to claim 12, wherein the flushing access is angularly displaced by a maximum of 120° about the centre of the central outlet opening from the peripheral inlet opening in the flow direction.

20. The vortex brake according to claim 12, wherein the vortex brake is adapted for non-demountable mounting.

* * * * *